US006082280A

United States Patent [19]

Wünsch et al.

[11] Patent Number: 6,082,280

[45] Date of Patent: Jul. 4, 2000

[54] TIE-TIPPING MACHINE

[75] Inventors: Reinhard Wünsch, Krefeld; Stefan Vierkötter, Kerken-Nieukerk, both of Germany

[73] Assignee: Herbert Janssen Nahmaschinen, Krefeld, Germany

[21] Appl. No.: 09/265,006

[22] Filed: Mar. 9, 1999

[30] Foreign Application Priority Data

Mar. 9, 1998 [DE] Germany ..... 298 04 084 U
May 28, 1998 [DE] Germany ..... 298 09 482 U

[51] Int. Cl.[7] ..... D05B 23/00

[52] U.S. Cl. ..... 112/470.26

[58] Field of Search ..... 112/470.26, 470.07, 112/470.09, 470.16, 470.18, 470.33, 475.08, 475.09

[56] References Cited

U.S. PATENT DOCUMENTS 5,513,589 5/1996 Frigerio ..... 112/470.26

*Primary Examiner*—Peter Nerbun
*Attorney, Agent, or Firm*—Herbert Dubno; Andrew Wilford

[57] ABSTRACT

A tie-tipping apparatus has a base plate formed with a throughgoing stitch slot having relative to a longitudinal centerline a pair of symmetrically angled end-seam sections meeting at the centerline and a pair of side-seam sections extending generally parallel to the centerline, symmetrically flanking the centerline, and crossing the respective end-seam sections. Respective positioning plates juxtaposed with the end-seam sections are adapted to press a piece of liner fabric and a piece of finish fabric against the base plate and are each movable generally transversely of the respective end-seam sections between a rear position longitudinally rearward of the respective end-seam sections and an advanced position advanced longitudinally forward and extending over the respective end-seam sections. An actuator connected between the base plate and the positioning plates can displace the positioning plates from their rear positions to their advanced positions.

14 Claims, 6 Drawing Sheets

TIE-TIPPING MACHINE

FIELD OF THE INVENTION

The present invention relates to a tie-tipping machine. More particularly this invention concerns an apparatus for stitching the finish goods to a liner while leaving an acceptable margin width.

BACKGROUND OF THE INVENTION

In the production of a necktie it is necessary to apply a lining to the back of the finish goods at both the broad and narrow tip ends of the tie. This lining must be stitched to the finish goods along a pair of angled end seams that meet at a point at the very tip of the tie, and along a pair of side seams that extend generally parallel to each other from outer ends of the ends seams up the goods somewhat.

Such seams are normally produced manually by juxtaposing the finish goods and liner together, good faces in, and then forming the stitching. Since the lining must not be visible from the front of the tie, it is necessary to provide some margin clearance in that the finish goods must wrap at the end seams at least around to the back through a distance of 5 mm to 10 mm.

This is done by first stitching the two end seams, then carefully shifting the finish goods by the seam allowance forward, and then stitching the side seams with some offset to allow for margin clearance there too. If done expertly the result is quite neat and very attractive, so the job must normally be done by a highly skilled stitcher.

Accordingly a tie-tipping apparatus has been proposed that forms three folds in the finish goods, one down the center and one along each side, and holds the goods like this so the end and side seams can be stitched. The side seams cannot overlap the end seams and the resultant tie is of clearly inferior quality, easily recognized as machine-made.

OBJECTS OF THE INVENTION

It is therefore an object of the present invention to provide an improved tie-tipping apparatus.

Another object is the provision of such an improved tie-tipping apparatus which overcomes the above-given disadvantages, that is which allows the tie tip to be stitched with the finish goods and liner positioned largely automatically by the machine while producing a high-quality apparently hand-made tie.

SUMMARY OF THE INVENTION

A tie-tipping apparatus according to the invention has a base plate formed with a throughgoing stitch slot having relative to a longitudinal centerline a pair of symmetrically angled end-seam sections meeting at the centerline and a pair of side-seam sections extending generally parallel to the centerline, symmetrically flanking the centerline, and crossing the respective end-seam sections. Respective positioning plates juxtaposed with the end-seam sections are adapted to press a piece of liner fabric and a piece of finish fabric against the base plate and are each movable generally transversely of the respective end-seam sections between a rear position longitudinally rearward of the respective end-seam sections and an advanced position advanced longitudinally forward and extending over the respective end-seam sections. An actuator connected between the base plate and the positioning plates can displace the positioning plates from their rear positions to their advanced positions.

The positioner constituted by the positioning plates serves for two different functions. First its diagonal movement inward toward the tie centerline produces a center fold right on the centerline that is maintained as the end seams are stitched. Then they are moved out to draw out this fold, pull the finish goods around to the back of the tie, and allow side seams to be formed that cross the end seams so that when the two pieces, which are positioned with their good sides together, are inverted the seam allowance will all lie to one side. The result is as neat a job as could be produced by an expert stitcher, but which is mainly done by the machine, without the use of an expert machine operator. In fact the finished product, with the tip produced largely by machine, cannot be distinguished from a hand-stitched tie.

According to the invention an abutment movable longitudinally underneath the base plate is engageable with a fabric edge engaging through the slot. This abutment ensures that the seam allowance is pushed to the inside before the side seams are formed so that the finished tie tip will be perfectly flat and smooth. This abutment has a shape corresponding to the end-seam sections and can be fixed in the machine or formed as a raised portion of it.

The base plate in accordance with the invention is provided with means for mounting it on a sewing machine. Thus it is mounted like the presser foot and its position can be controlled similarly.

The base plate has an upper surface turned toward the positioning plates and provided with an antislip layer and similarly the positioning plates have lower surfaces turned toward the base plate and provided with antislip layers. If the two fabrics do not slide readily on each other a separate smooth slip plate is provided between the positioning plates and the base plate which can be fixed on the positioning plates or on the base plate. This slip plate can also be used to apply a label to the lining.

A hinge is provided for pivoting the positioning plates upward away from the base plate into a position spaced well from the base plate. The hinge axis can extend horizontally either parallel or perpendicular to the tie centerline. Such a hinge allows the apparatus to be loaded easily.

The positioning plates have front edges extending parallel to the end-seam section and longitudinal slots overlying the side-seam sections in the intermediate positions of the positioning plates between the respective rear and advanced positions. In addition the longitudinal slots of the positioning plates are longer by a margin clearance than the respective side-seam sections.

The actuator is adapted to latch in any of the positioning plates. Thus it does not need to be held while the critical end seams are stitched which is particularly convenient when the device is used manually and not in a wholly automatic stitching system.

In accordance with the invention a guide plate fixed relative to the base plate is formed with slots in which are guided pins on the positioning plates. At least some of the slots extend generally perpendicular to the end-seam sections Thus the guide plate is moved longitudinally and the angled slots convert this longitudinal movement into angled movement of the positioning plates perpendicular to the end-seam sections.

The outer end of the base plate past the end-seam sections can be hinged so that it is swung downward out of the way as the workpieces are laid in place and the end seams are formed. Then it is swung up to capture these pieces in a slot formed between the outer hinged part and the stationary part of the base plate.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
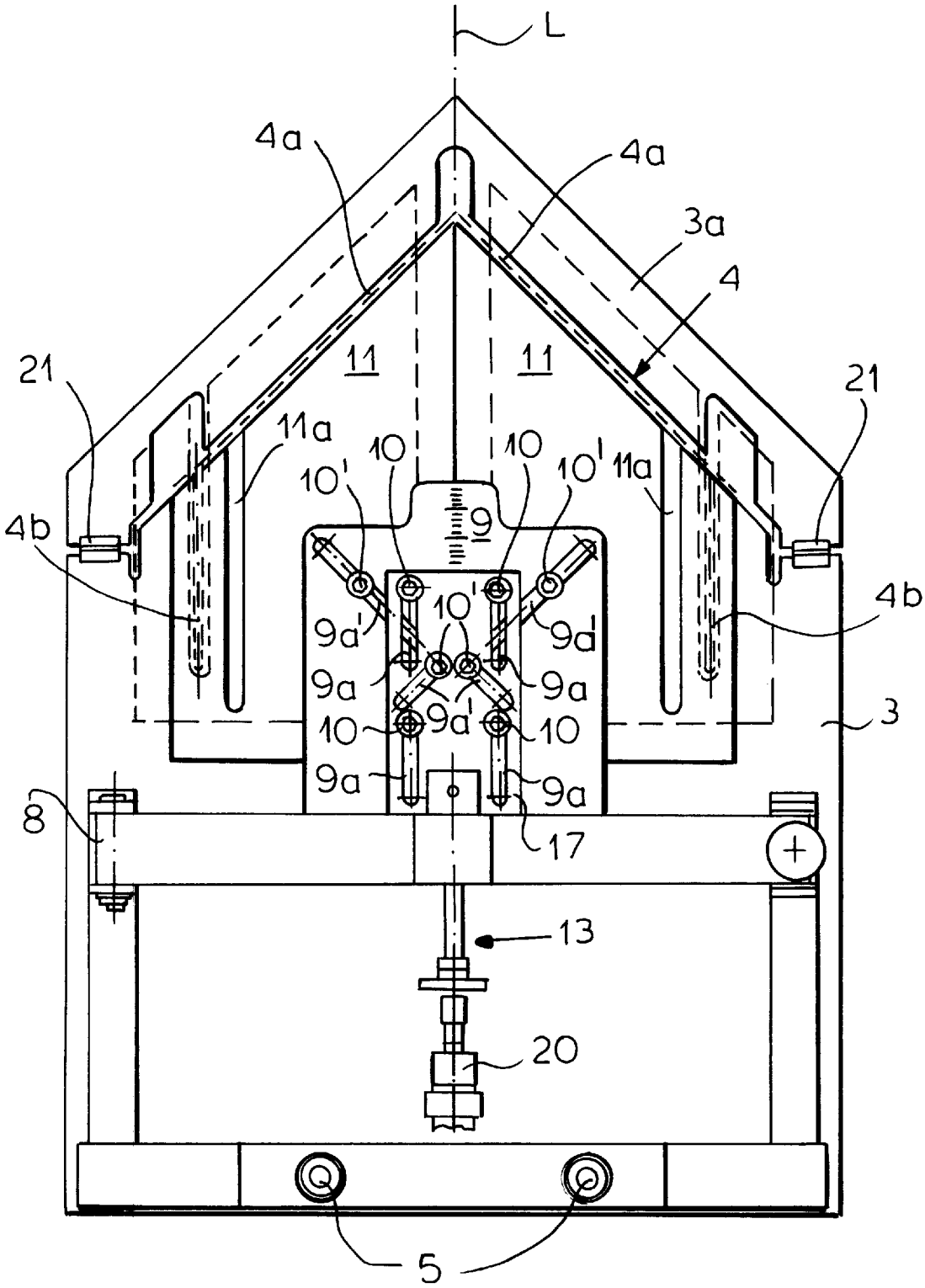
FIG. 1 is a partly diagrammatic top view of a tie-tipping machine according to the invention.
Figure 2:
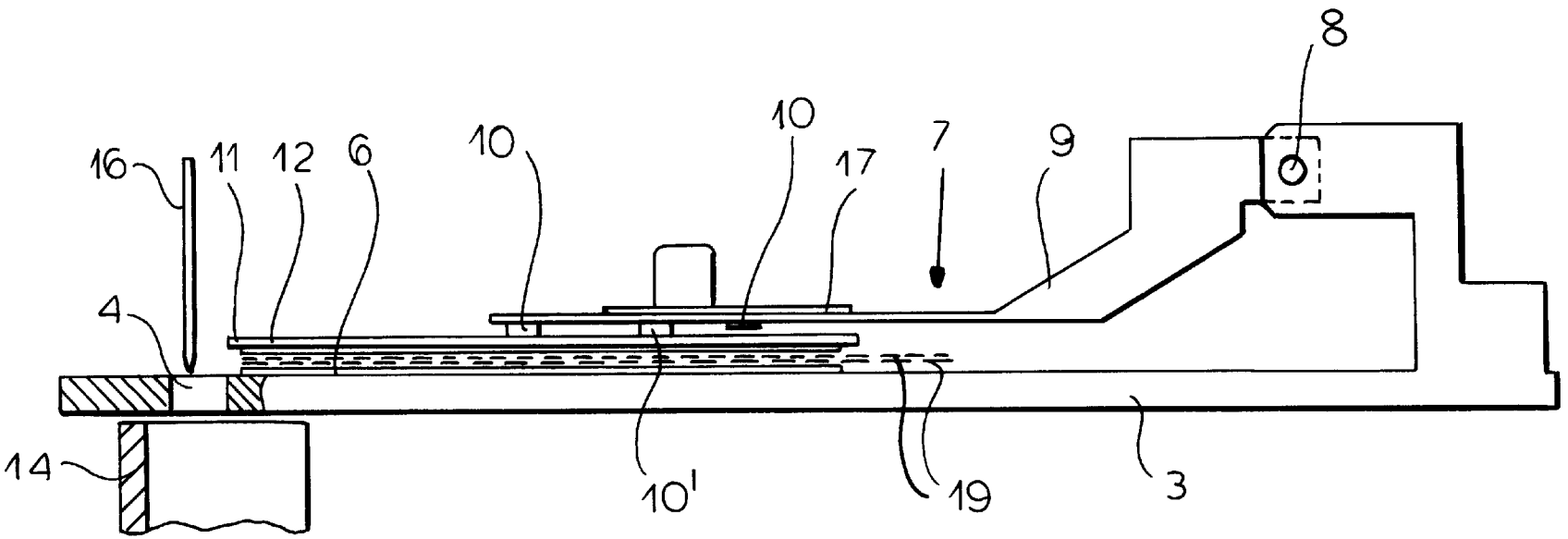
FIGS. 2 and 3 are partly schematic side views of a tie-making apparatus in the open and closed positions, respectively.
Figure 3:
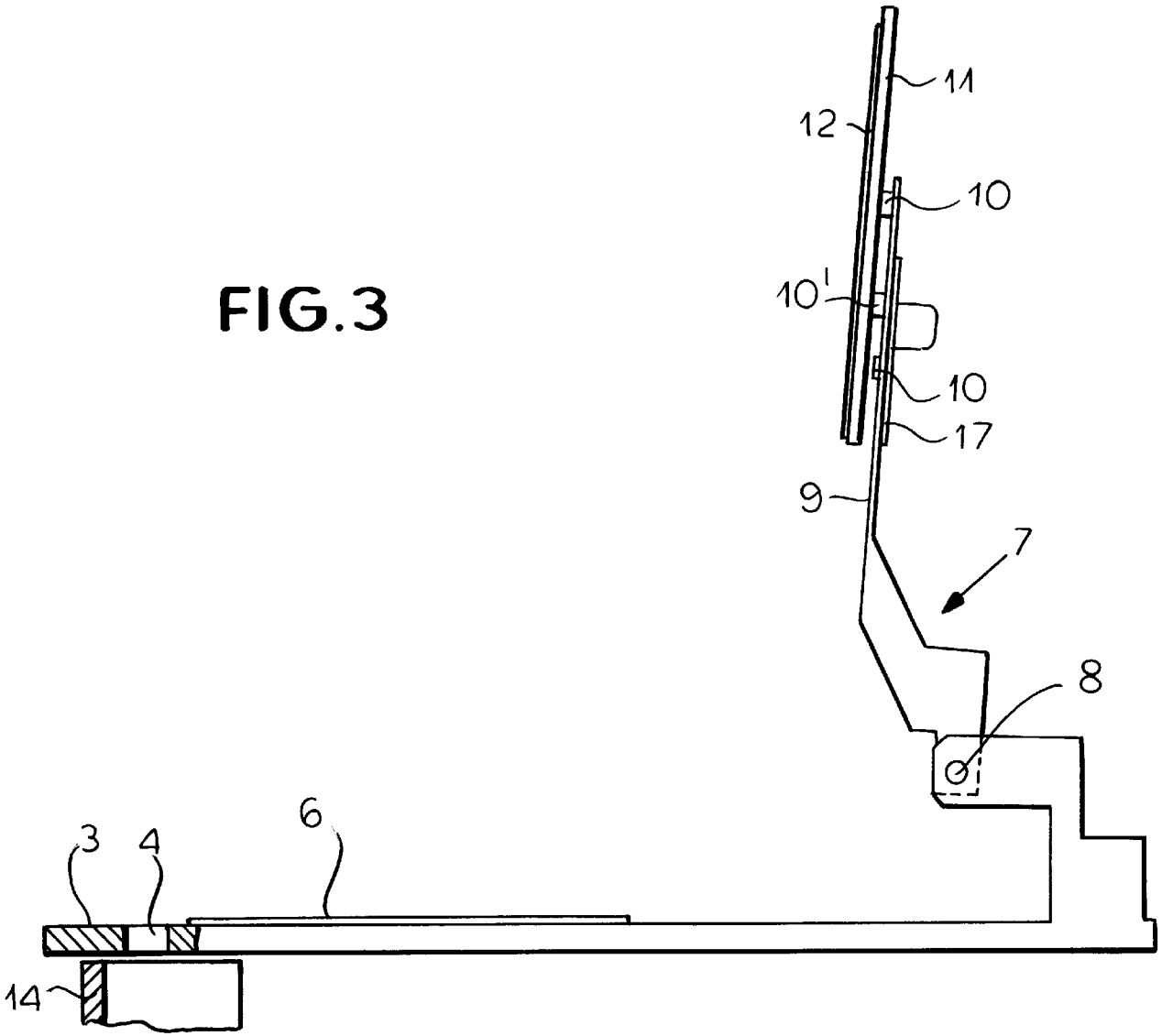

As seen in FIGS. 1 through 3 a tie-tipping machine according to the invention has a base plate 3 formed with a V-shaped end-seam slot 4 and provided with coupling nuts 5 allowing it to be mounted in a standard computer-controlled production sewing machine, either of the lock- or chain-stitch type having a stitching needle 16. The upper face of the plate 3 is provided with a friction or antislip layer 6 intended to prevent a piece 1 (FIGS. 4*a*–4*c*) of liner goods from creeping on it. The slot 4 has a pair of end-seam sections 4*a* that meet at a central point and run symmetrically to a centerline L of the device, and a pair of side-seam sections 4*b* that symmetrically flank and extend generally parallel to the centerline L and that extend across the respective end-seam sections 4*a*. The plate 3 can have a front portion 3*a* forward of the slot 4 that is mounted via hinges 21 at the end-seam sections 4*a* for pivoting between a position coplanar with the plate 3 and a position projecting downward therefrom. Alternately this front portion 3*a* can be made of a flexible material such as pertinax or spring steel so it can be deformed downward to open up the slot 4.

A device 7 for positioning a piece of finish goods (FIGS. 4*a*–4*c*) is pivoted at 8 on the base plate 3, in FIG. 1 about an axis perpendicular to that shown in FIGS. 2 through 4*c*. The device has a support plate 9 lying against the top faces of the plates 11 and, immediately atop this plate 9 a positioning plate 17 that is movable parallel to the centerline L of the device by means of an actuator 13 that can be operated manually or by means of, for instance, a pneumatic cylinder 20 controlled by the sewing machine. The plates 11 have slots 11*a* running parallel to the centerline L and extending up to their front edges which lie, to start with, just behind the rear edges of the end-seam slot 4.

Pins 10 projecting upward from the plate 9 engage in longitudinally extending slots 9*a* of the plate 17 so that this plate 17 can only move longitudinally relative to the plate 9. Pins 10' projecting upward from the plates 11 glide in angled slots 9*a'* of the plates 9 and 17 so that when the plate 17 is moved longitudinally forward (upward in FIG. 1, to the left in FIGS. 2 through 4*c*) the plates 11 are moved forward and apart toward the positions shown in dashed lines in FIG. 1, that is perpendicularly across the respective sections 4*a* of the stitch slot 4. Underneath the plate 3 the sewing apparatus has an abutment 14 that can be moved longitudinally back and forth with respect to the slot 4. This abutment 14 can either be a separate element, or a stationary part of the sewing machine on which the inventive device is mounted and relative to which it can be moved.

This device is operated as follows:

To start with the device 7 is pivoted up and first a piece 1 of liner fabric is laid on the plate 3 and then a piece 2 of the outer or finish fabric, with the two pieces 1 and 2 extending forward past the end-seam slot 4 and the good sides of the pieces 1 and 2 against each other. If the two pieces 2 and 3 do not slide readily on each other, a slip plate 19 can be set between them as indicated in dot-dash lines in FIG. 2. Such a slip plate 19 can also be pivoted on the plate 3 or on the device 7 as described in German Utility Model 298 04 084. It can also be used to apply a label to the tie being stitched by holding down a label that projects across one of the end-seam sections 2*a* so that, when the end seams are stitched it is secured in place.

To this end the plate 19 can be formed with a seat in which the label fits to hold it in position during the stitching operation.

Then, after advancing the plate 17 so that the plates 11 are in the position shown in dot-dash lines in FIG. 1, the positioner 7 is set down atop the finish fabric 2 so that its antislip layer 12 engages it.

Figure 4A:
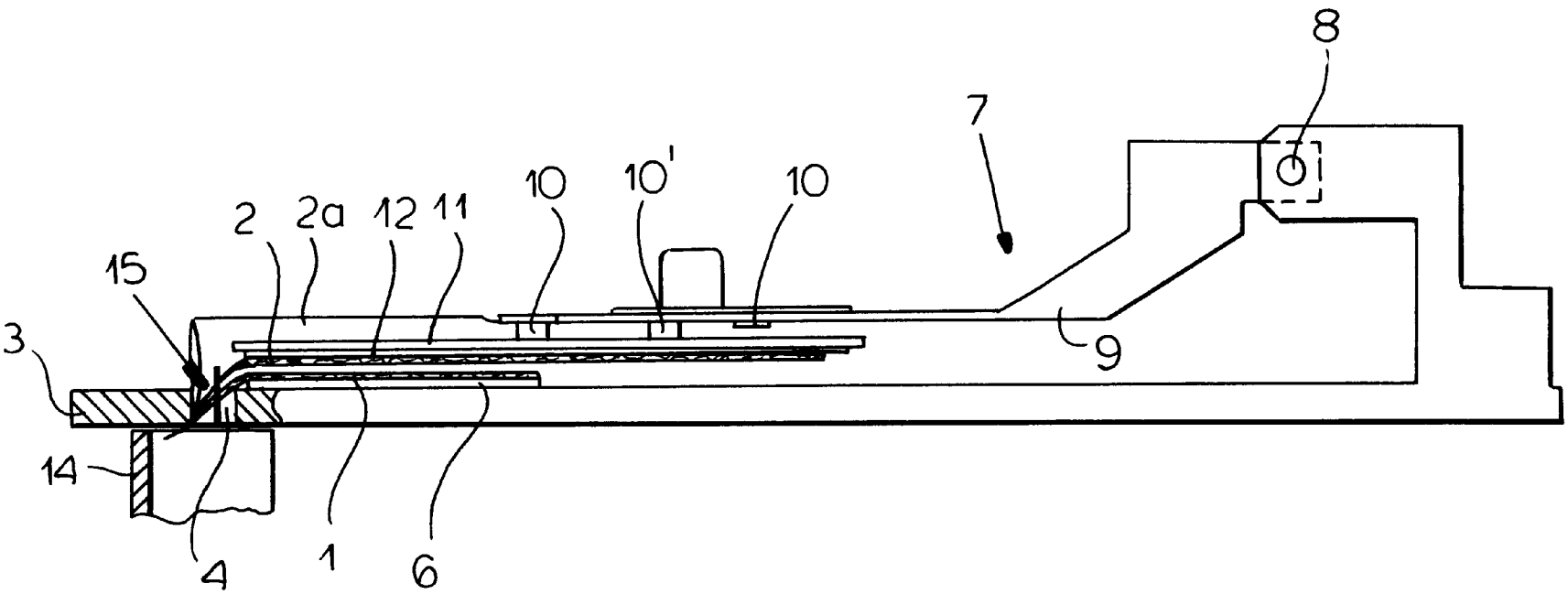
FIGS. 4*a* through 4*c* are side views illustrating operation of the apparatus.

The plate 17 is then retracted to move the two plates 11 transversely together. The fabric 2 will be entrained but the liner 1 will not be, so that a fold 2*a* will form lying on the centerline L and poking up between the two plates as shown in FIG. 4*a*. In this position the needle 16 is used to form the V-shaped end seam along the slot 4, producing a seam allowance 15 that is inherently pushed down somewhat in to the slot 4.

Figure 4B:
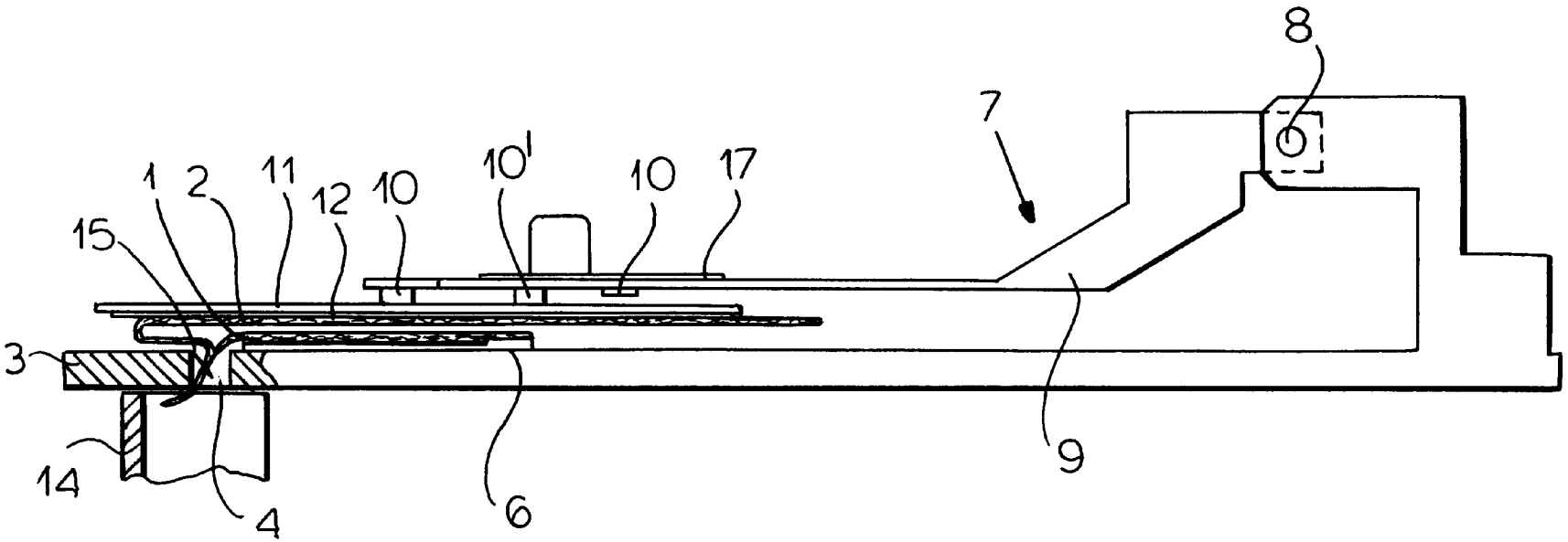
Figure 4C:
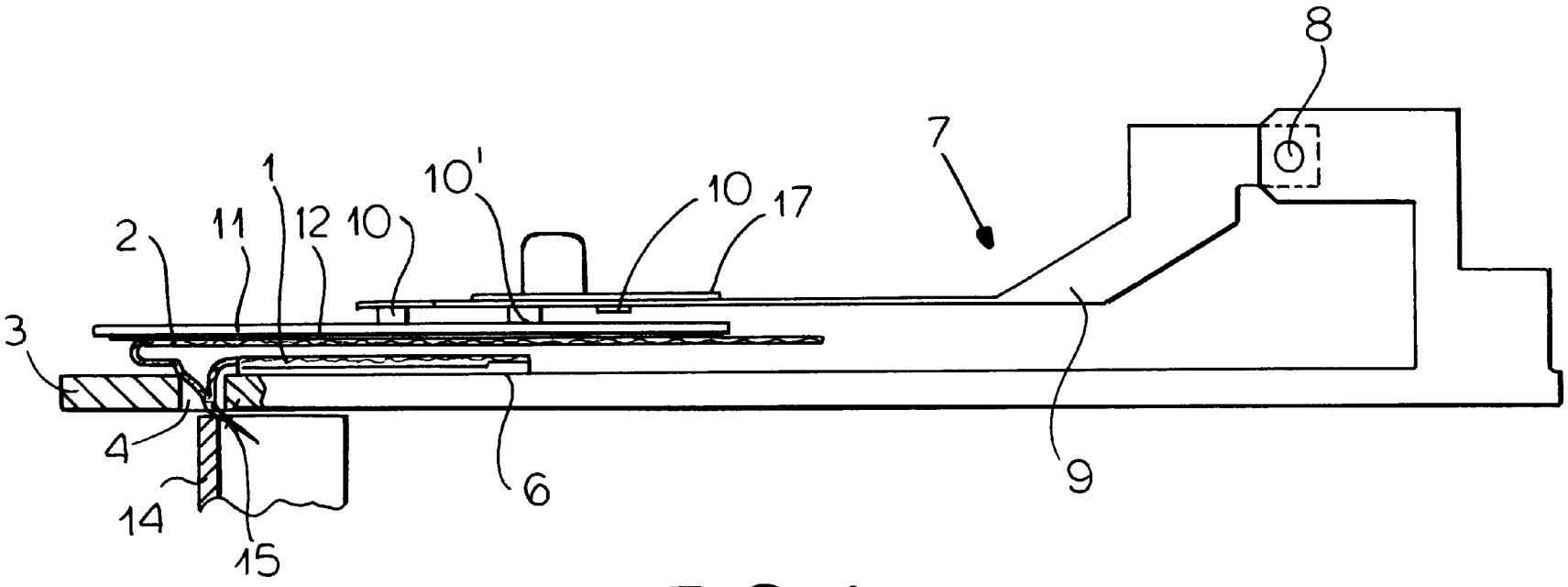

In order to form the side seams that extend roughly parallel to the line L, the plates 11 are then advanced, moving diagonally apart and taking all of the fold 2*a*. Since the liner piece 1 is held stationary by the antislip layer 6, the finish fabric 2 will be pulled over and back to form on the back of the goods the desired margin clearance with an S-shape as shown in FIG. 4*b*. The plates 11 are advanced to an outer position in which the slots 11*a* are aligned with the side-seam sections 4*b*. The abutment 14 is then moved back as shown in FIG. 4*c* to convert the S-shape to a U-shape. Then the side seams can be stitched along the aligned slots 11*a* and 4*b* across the end seams, that is into the seam allowance projecting past the end-seam stitching.

Thereafter positioner 7 is lifted and the two stitched-together pieces are lifted off the device and inverted, producing a perfect tie tip where the finish fabric is rolled over and extends a short distance past the tip edge to the back of the tie.

We claim:

1. A tie-tipping apparatus comprising:

a base plate formed with a throughgoing stitch slot having relative to a longitudinal centerline a pair of symmetrically angled end-seam sections meeting at the centerline and a pair of side-seam sections extending generally parallel to the centerline, symmetrically flanking the centerline, and crossing the respective end-seam sections;

respective positioning plates juxtaposed with the end-seam sections, adapted to press a piece of liner fabric and a piece of finish fabric against the base plate, and each movable generally transversely of the respective end-seam sections between a rear position longitudinally rearward of the respective end-seam sections and an advanced position advanced longitudinally forward and extending over the respective end-seam sections; and actuating means connected between the base plate and the positioning plates for displacing the positioning plates from their rear positions to their advanced positions.

2. The tie-tipping apparatus defined in claim 1, further comprising an abutment movable longitudinally underneath the base plate and engageable with a fabric edge engaging through the slot.

3. The tie-tipping apparatus defined in claim 2 wherein the abutment has a shape corresponding to the end-seam sections.

4. The tie-tipping apparatus defined in claim 1 wherein the base plate is provided with means for mounting it on a sewing machine.

5. The tie-tipping apparatus defined in claim 1 wherein the base plate has an upper surface turned toward the positioning plates and provided with an antislip layer.

6. The tie-tipping apparatus defined in claim 5 wherein the positioning plates have lower surfaces turned toward the base plate and provided with antislip layers.

7. The tie-tipping apparatus defined in claim 1, further comprising hinge means for pivoting the positioning plates upward away from the base plate into a position spaced well from the base plate.

8. The tie-tipping apparatus defined in claim 1 wherein the positioning plates have front edges extending parallel to the end-seam section and longitudinal slots overlying the side-seam sections in the intermediate positions of the positioning plates between the respective rear and advanced positions.

9. The tie-tipping apparatus defined in claim 8 wherein the longitudinal slots of the positioning plates are longer by a margin clearance than the respective side-seam sections.

10. The tie-tipping apparatus defined in claim 1 wherein the actuating means is adapted to latch in the rear positions of the positioning plates.

11. The tie-tipping apparatus defined in claim 1 further comprising a guide plate fixed relative to the base plate and formed with slots; and pins on the positioning plates guided in the slots.

12. The tie-tipping apparatus defined in claim 11 wherein at least some of the slots extend generally perpendicular to the end-seam sections.

13. The tie-tipping apparatus defined in claim 1, further comprising a smooth slip plate between the positioning plates and the base plate.

14. The tie-tipping apparatus defined in claim 1 wherein the base plate is has a downwardly deflectable front portion longitudinally forward of the end-seam sections.

* * * * *